United States Patent [19]

Cockrell

[11] 4,035,023

[45] July 12, 1977

[54] APPARATUS AND PROCESS FOR HYDRAULIC MINING

[75] Inventor: Clifford McDonald Cockrell, New Orleans, La.

[73] Assignee: Freeport Minerals Company, New York, N.Y.

[21] Appl. No.: 596,006

[22] Filed: July 15, 1975

[51] Int. Cl.[2] ..... E21C 41/08

[52] U.S. Cl. ..... 299/17; 166/68; 166/105; 166/54; 299/5

[58] Field of Search ..... 299/17; 37/61, 62; 302/15; 166/314, 68, 105, 53, 54

[56] References Cited

U.S. PATENT DOCUMENTS

| | | | |
|---|---|---|---|
| 3,155,177 | 11/1964 | Fly | 299/17 X |
| 3,730,592 | 5/1975 | Wenneborg | 299/17 |
| 3,747,696 | 7/1973 | Wennenborg | 299/17 X |
| 3,758,238 | 9/1973 | Erickson | 417/408 |
| 3,816,027 | 6/1974 | Miscovich | 302/15 X |

*Primary Examiner*—Ernest R. Purser
*Assistant Examiner*—William F. Pate, III
*Attorney, Agent, or Firm*—Bruce H. Troxell

[57] ABSTRACT

Apparatus for and process of mining a subterranean granular ore deposit through a well bore where the ore is eroded from the ore matrix by one or more laterally directed jets of fluid, e.g. water, forming an ore-bearing slurry. The apparatus comprises:

a. a rotatable tool string having a first fluid passage through which fluid flows downwardly and a first slurry passage through which a slurry of said fluid and granular ore flows upwardly, b. supported therefrom underground a substantially rigid housing containing an outwardly directed cutting jet nozzle for impinging said fluid against said ore to form said slurry and having 1. a second fluid passage therein connecting said first fluid passage with said jet nozzle,
2. a slurry inlet through said housing,
3. a second slurry passage connecting said inlet with said first slurry passage, and
4. a valve for controlling the amount of slurry passing through said second slurry passage and into said first slurry passage, said valve being biased to close and powered to open by hydraulic pressure in a fluid passage.

In another embodiment the apparatus includes a mining head or housing having a "downhole" level controller which controls the level of slurry in relation to the housing by regulating the valve controlling the rate of slurry being removed to the surface. Also, there can be included in the housing valve means regulated by the level controller to control the rate of fluid added to the ore body through the jet nozzle or nozzles, air lift means and auxiliary air lift means to assist the lifting of the slurry to ground level, check valve means to prevent reverse flow of fluid travelling to the jet nozzle or nozzles, one or more bottom jets to prevent restriction of movement of the mining head, one or more underreaming jet nozzles for cutting out a surge chamber in said ore body, and optionally a turbine driven by the descending fluid and a pump driven by the turbine for pumping slurry to the surface in those cases where the ore formation will not hold air pressure or in deep well applications. Ground level components are also provided for controlling the slurry level in relation to the mining head by means of controlling the back pressure in the slurry return line.

14 Claims, 12 Drawing Figures

FIG. 4
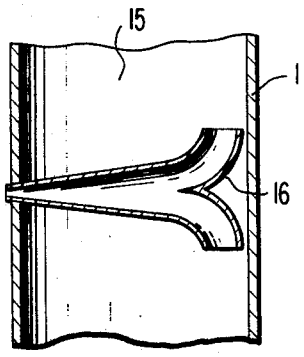
FIG. 3
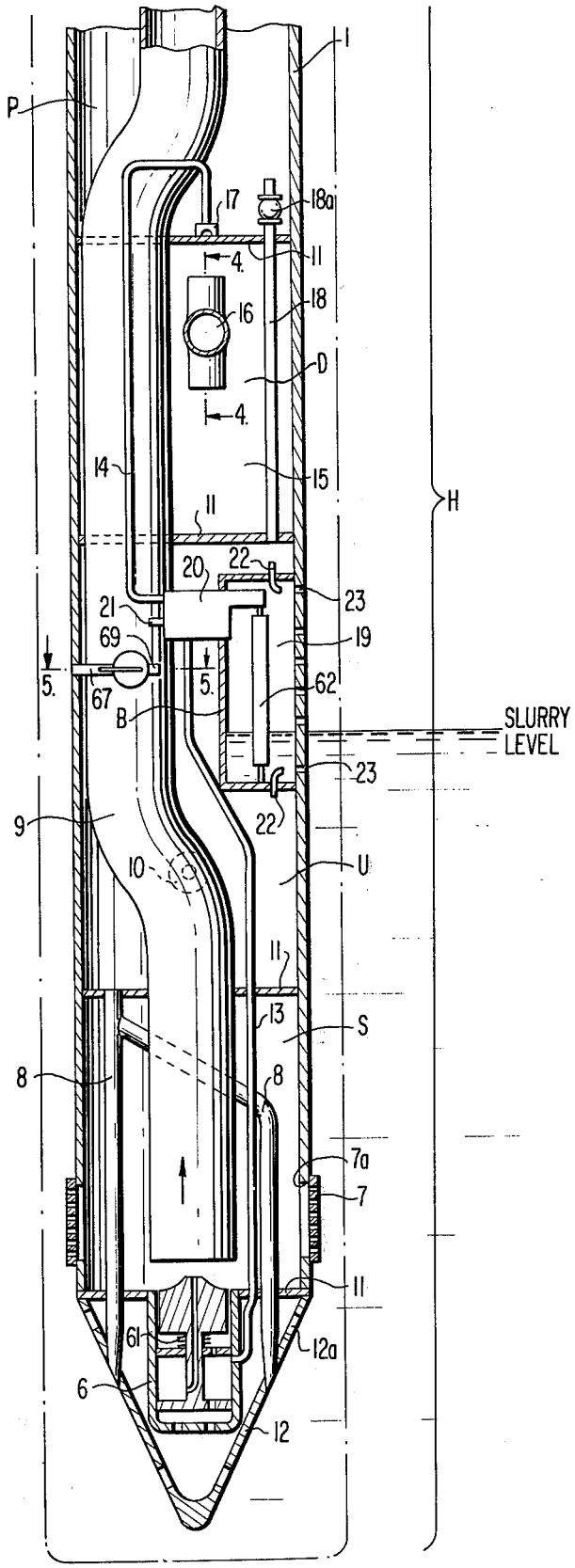
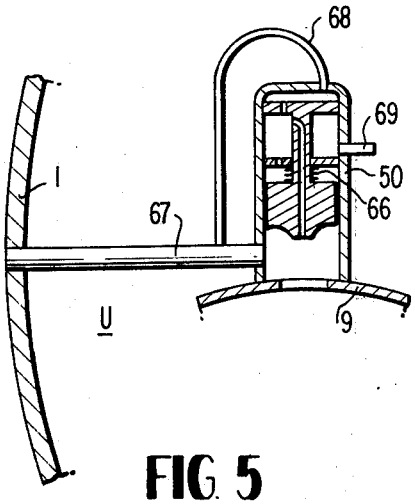
FIG. 5

FIG. 7
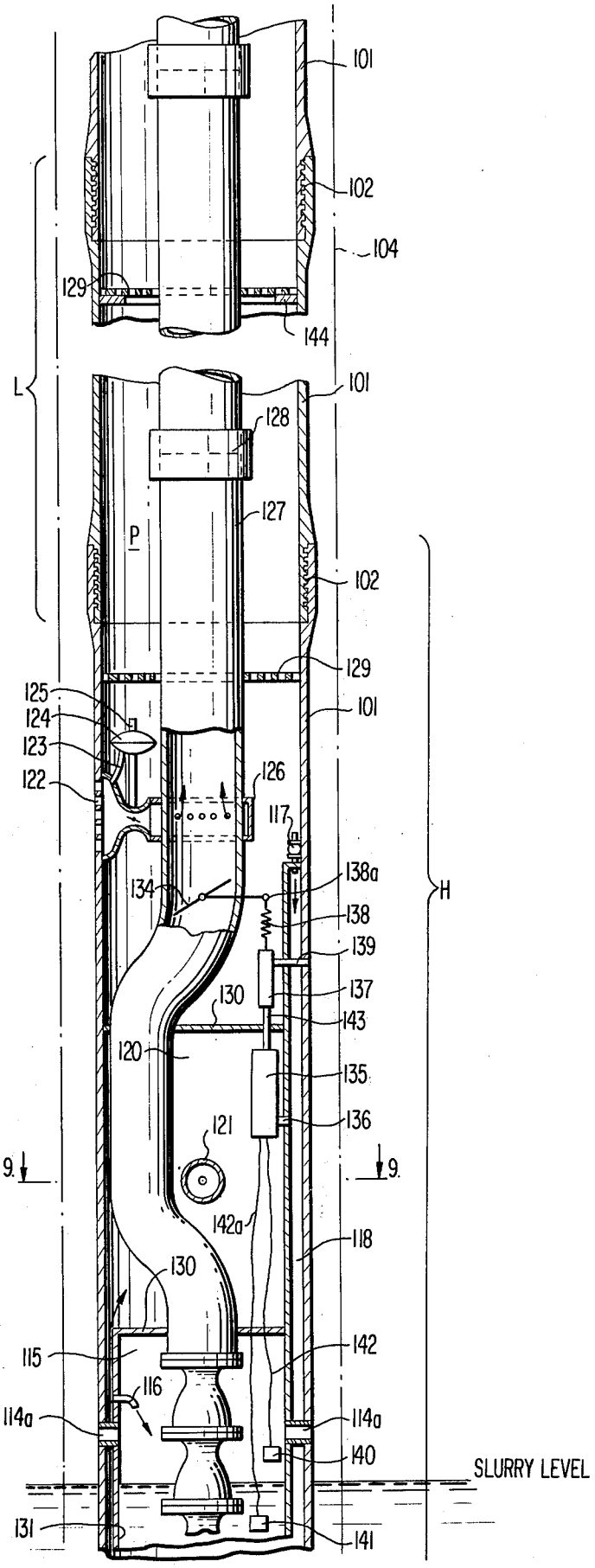
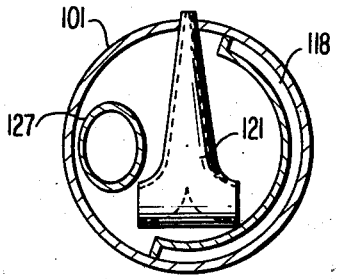
FIG. 9

APPARATUS AND PROCESS FOR HYDRAULIC MINING

BACKGROUND OF THE INVENTION a. Field Of The Invention

The present invention relates to various novel apparatus and processes for mining subterranean deposits of granular ore such as phosphate rock or any other similar material.

b. Description of The Prior Art

Subterranean deposits have been found that cannot be mined by conventional mining apparatus or methods or by dredging. For example, phosphate ore bodies have been found at depths ranging from 150 to 300 feet or more below the ground surface. This is far beyond the reach of dredges and conventional mining methods are inapplicable because the water table is usually encountered a short distance below ground level, e.g., 5 to 10 feet in some cases.

Various methods have been used heretofore in attempts to mine granular ore deposits existing so far below ground level. One method that has been attempted involved the use of compressed air for forcing the slurry to the ground level. The problem with this system has been the lack of suitable controls on the slurry level in relation to the mining head resulting in many cases in blowbacks up through the tool string and in rapid depressurization in the ore cavity. These irregularities also prevent proper density control. Not only did this waste time and work, it could result in the loss of expensive equipment because of overburden subsidence due to a sudden increase in differential pressure across the seal between the water string and the overburden. The lack of blowback prevention also complicates the addition or removal of sections from the tool string after the ore cavity has been pressurized with air and usually would require prior depressurization resulting in loss of compressed air and additional time entailed in depressurization and subsequently repressurizing.

Pfefferle U.S. Pat. No. 3,439,953 discusses the problems of sudden pressure loss in air pressurized ore cavities and teaches mining while the cavity is full of water until a suitable sized sump is created to facilitate control of the slurry level and prevent it from dropping below the eductor tube through which slurry is sent to the surface. There is no mention in this patent of a valve for the purpose of closing the slurry return passage. Furthermore, the tool string used in the Pfefferle apparatus employs four separate pipes or tubes extending from the ore cavity to ground level and this considerably complicates the assembly and disassembly of the sections of the tool string. In the absence of blowback controls, the Pfefferle apparatus does not permit addition or removal of sections while the ore cavity remains pressurized or the conservation of the pressurized air upon cessation of mining in the cavity for use in another cavity.

Pumps based on the venturi principle have been tried in the mining head. These attempts are exemplified in Fly U.S. Pat. Nos. 3,155,177 and 3,316,985 and in Wenneborg 3,747,696. No provision is made in any of these patents, however, for the prevention of blowbacks by means of a downhole valve which controls the slurry return passage to close it in the event the slurry level in the ore cavity reaches a predetermined low level. The apparatus of the Fly patents utilizes a downhole slurry level detector which sends a signal to ground level for the purpose of actuating a control mechanism to regulate the throttle valve of a diesel engine which drives a pump delivering water down the hole. An arrangement of this type functions to deliver more water down the hole when the slurry level in the ore cavity drops and less when it rises. The Fly apparatus is not readily adapted to be used in systems utilizing pressurized air in the ore cavity and is unable to gain the advantages of such systems including the cavity wall support and the provision of pumping and air lift assistance characteristics of such systems. Also, the Fly apparatus and process requires the transmission of an electrical signal from the slurry level in the ore cavity to the ground surface which necessitates the provision of special insulation against grounding and imparts the risk of faulty signals or disrupted signals due to accidental grounding or shorting.

The Wenneborg device incorporates a drilling bit and jet mining nozzles. It also is not readily adaptable for use in pressurized air systems and lacks any blowback prevention arrangement. In addition the Wenneborg device utilizes a more complicated tool string which includes an extra water line and thus renders more difficult the addition of sections as the tool string is lowered. Furthermore, the Wenneborg device does not appear to have any means for measuring or controlling the slurry level in the ore cavity.

Donaldson et al U.S. Pat. No. 3,030,086 uses an air lift for raising the slurry to the surface. The tool string used in this apparatus is very complex and difficult to assemble when adding or removing sections. It also fails to provide any blowback prevention device and is not well adapted to use in air-pressurized ore cavities.

Other patents relating to apparatus for the mining of granular ores and similar apparatus but appearing to be less pertinent include U.S. Pat. Nos. 811,275; 908,113; 931,057; 1,960,932; 2,019,968; 2,127,265; 2,210,582; 2,376,974; 2,412,765; 2,518,591; 2,599,980; 2,678,203; 2,720,381; 2,745,647; 2,772,868; 3,153,290; 3,311,414 and 3,797,590.

SUMMARY OF THE INVENTION

The present invention provides apparatus and methods for mining subterranean deposits of granular ore involving the lowering of a tool head mounted to the end of a tool string into a prebored hole leading to the ore deposit. Fluid, e.g., water, under pressure is pumped down the hole and caused to impinge upon the ore to wash away the ore and form a slurry of the ore and fluid which is forced back up to ground level.

The apparatus of this invention comprises a rotatable tool string which has a first fluid (water) passage through which fluid passes downwardly to the ore body. It also has a first slurry passage through which the slurry passes upwardly to ground level. The tool string at its underground end supports a tool head which comprises a rigid housing containing at least one outwardly directed cutting jet for impinging the fluid against the ore to form the slurry. The tool head housing has:

1. a second fluid passage which connects the first fluid passage of the tool string with the jet,
2. a slurry inlet through the housing,
3. a second slurry passage which connects the inlet with the first slurry passage of the tool string, 4. a valve for controlling the amount of slurry passing upwardly through the second slurry passage to ground level.

This arrangement prevents blowback through the slurry passages and resultant loss of air pressure thereby, when the ore cavity is pressurized with air.

A level controller can be used for detecting the underground level of slurry adjacent the housing and is adapted to actuate the valve towards the closed position when the slurry level reaches a predetermined minimum and towards the open position when the slurry level reaches a predetermined maximum. This arrangement permits the automatic modulation of the flow for attainment of the most effective slurry level for the most efficient operation for the cutting jet nozzle and the most efficient removal of slurry from the cavity and delivery to ground level.

A second valve can be located in the second fluid passage in the tool head for controlling the rate of fluid flow to the cutting jet. This valve is actuated by the level controller towards the closed position when the slurry level reaches a predetermined maximum and towards the open position when the slurry level reaches a predetermined minimum. It also assists in blowback prevention in those cases where an air-pressurized cavity is employed, by automatically increasing the fluid flow into the cavity when the slurry level drops and the slurry-air interface approaches the slurry inlet through the housing to the slurry passage.

It is also of advantage and therefore preferable to incorporate at least one bottom jet nozzle in the lower end of the tool head housing to impinge a jet or jets or fluid into the areas adjacent and below the housing. The bottom jet nozzle or nozzles are connected to the first fluid passage by means of a third fluid passage in the housing. This maintains agitation and flow around the exterior of the housing lower parts to prevent settlement of granular ore around the housing and to prevent obstruction of movement of the housing upwardly or downwardly or in rotation. It is also advantageous, if desired, to provide the third fluid passage with a check valve to permit passage of fluid to said bottom jet nozzle or nozzles but prevent flow of fluid or air back up through the fluid passages and resultant blowback.

Another preference, when the air-pressurized cavity is used, is the provision of one or more air lifts or passages opening from exterior of the housing to the interior of the second slurry passage in the housing at a point above the operating slurry level. The air passage conveys air from the cavity to the slurry moving up in the slurry passages to lower its density and ease its rise to ground level. It is advantageous to provide an air valve in the air passage. The air valve is powered towards the closed position by air pressure in the cavity and is powered towards the open position by fluid pressure in the first fluid passage. When two air lifts are used the air valve of the second one can be powered to open by fluid pressure in the third fluid passage. The air valve is adapted to move towards the closed position and decrease the flow of air into the slurry when the fluid pressure in the first fluid passage decreases and to move towards the open position and increase the flow of air into the slurry when the fluid pressure in the first fluid passage increases. The air valve closes when the fluid pressure in the first fluid passage reaches a predetermined minimum. This permits the assembly of additional sections in the tool string or removal thereof without the need for depressurizing the cavity and prevents blowback should fluid pressure in the first fluid passage drop intentionally or inadvertently.

An underreaming jet nozzle below the cutting jet nozzle is also preferred for the purpose of cutting a sump from the ore cavity. The sump provides a large capacity surge chamber to reduce the sensitivity required of the level controller and to provide ample time for corrective measures to be instituted by the controller.

This invention also makes it possible to utilize a ground level control system in conjunction with the air lift system to replace or supplement the downhole level controller for maintaining a proper slurry level in the cavity. The ground system separates the air from the slurry in the air-slurry mixture reaching ground level in a separator from which slurry is removed and air vented at controlled rates. By this means a back pressure is maintained on the slurry rising towards the surface. A reduction in back pressure is triggered by air being vented at too low a rate which indicates that the underground slurry level is too high because inflow of air through the air lift is discouraged by the resistance head in the rising slurry. The back pressure is decreased by increasing the rate of air being vented and slurry being removed. A reduced back pressure increases the flow of slurry and encourages the inflow of air through the air lift causing the underground slurry level to drop. An increase in back pressure is triggered by too high a rate of air being vented which indicates that too much air is inflowing through the air lift because the static head in the slurry line is too low indicating an abnormally low underground slurry level. A increased back pressure is produced by reducing the rate of removing slurry and venting air from the separator. By this means the underground slurry level controller is assisted in maintaining the proper underground slurry level.

The tool head can be equipped with a hydraulic turbine driven by the descending pressurized fluid and a slurry pump driven by the turbine. This combination can be used in very deep mining to assist the movement of the slurry to the ground surface. It can also be used in those mining areas where the formation is so weak that it sloughs in as mining proceeds and compressed air is ineffective in maintaining the integrity of the cavity structure or, because of leakage through the formation, is ineffective in forcing the slurry to the ground surface.

Other features and advantages of the present invention will be apparent from the appended drawings and the following detailed description.

BRIEF DESCRIPTION OF THE DRAWINGS

In the drawings:

FIG. 3 is a sectional view in elevation, partly broken away and partly in section, showing the lower portion of the apparatus of FIG. 1.

FIG. 4 is a sectional view taken on line 4—4 of FIG. 3.

FIG. 5 is an enlarged section taken on line 5—5 of FIG. 3.

FIG. 7 is a view in elevation, partly broken away and partly in section, showing the middle portion of the apparatus of FIG. 6.

FIG. 9 is a section taken on line 9—9 of FIG. 7.

DESCRIPTION OF SPECIFIC EMBODIMENTS

Figure 1:
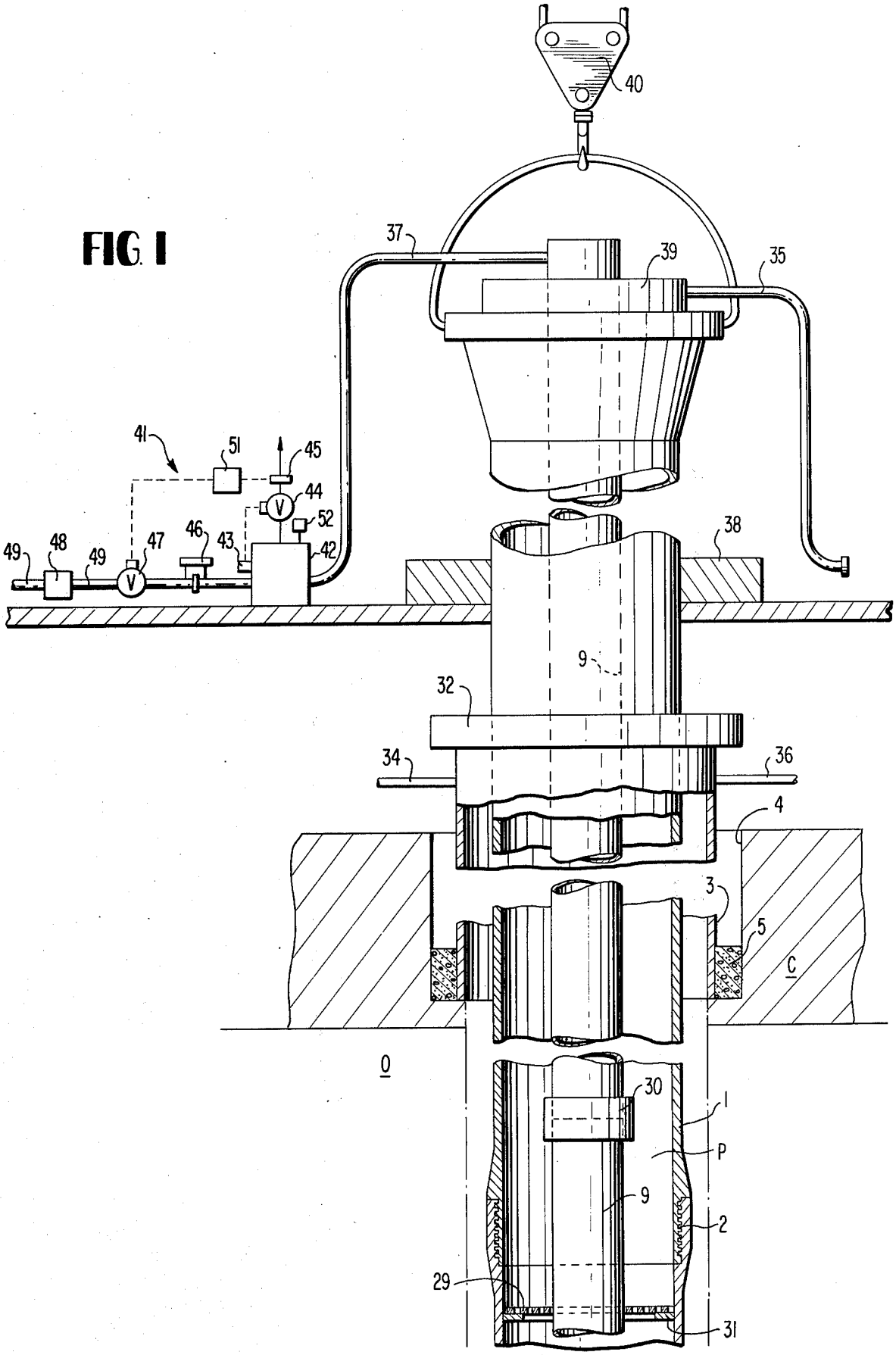
FIG. 1 is a view in elevation, partly broken away and partly in section, showing the upper portion of one embodiment of the mining apparatus of this invention.
Figure 2:
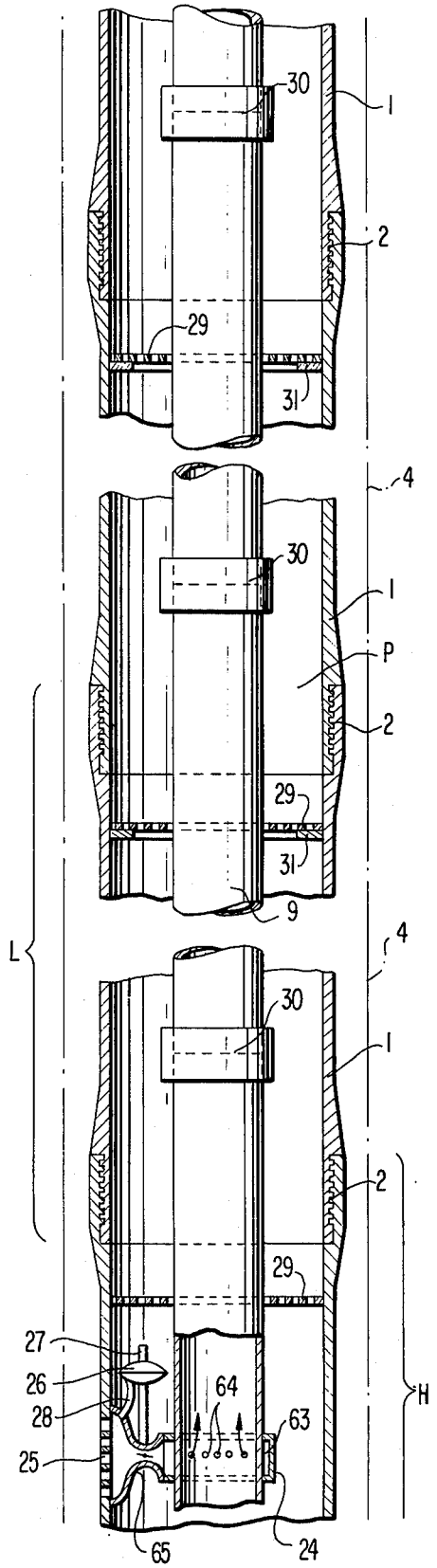
FIG. 2 is a sectional view in elevation, partly broken away and partly in section, showing the middle portion of the apparatus of FIG. 1.
Figure 6:
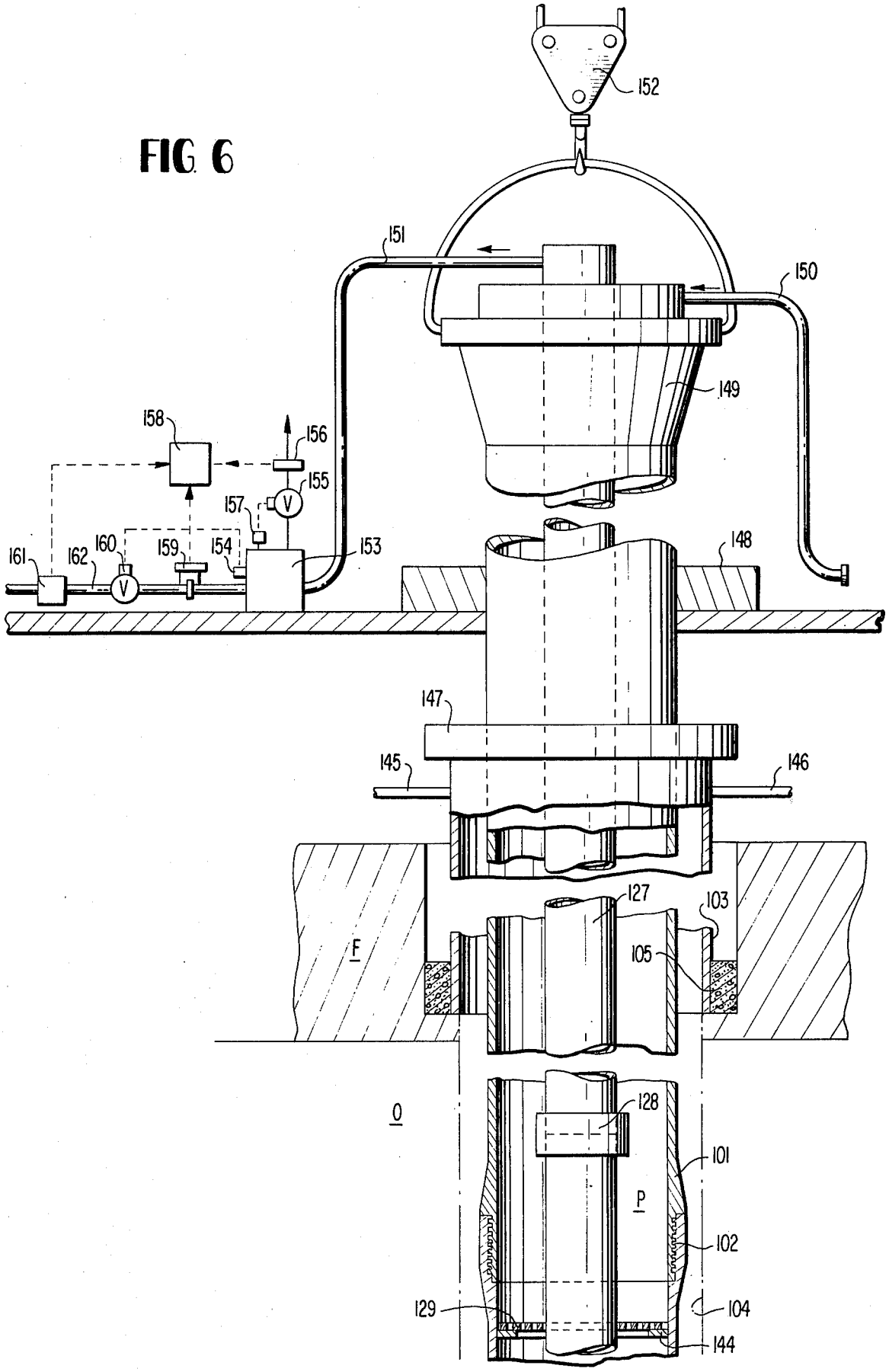
FIG. 6 is a view in elevation, partly broken away and partly in section, showing the upper portion of another embodiment of the mining apparatus of this invention.
Figure 10:
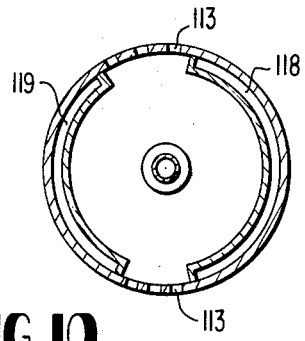
FIG. 10 is a section taken on line 10—10 of FIG. 8.
Figure 8:
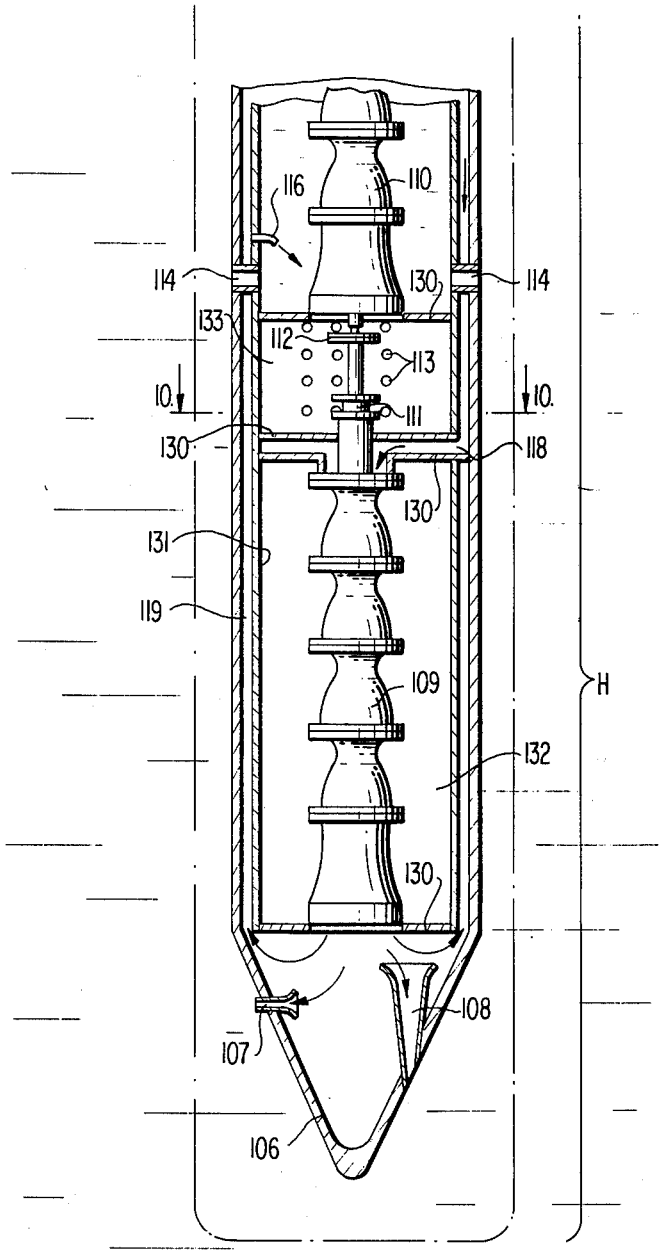
FIG. 8 is a view in elevation, partly in section and partly broken away, showing the lower portion of the apparatus of FIG. 6.

As exemplified in FIGS. 1–5, one embodiment of the jet miner system of this invention utilizes a tool string comprising a vertical cylindrical jacket 1 which is fabricated in several lengths or sections L which are joined together with Hydril-type joints 2. The sections are assembled during the process of insertion into a predrilled well bore 4 through protective casing 3 which is sealed to the formation with cement 5. Slurry return pipe 9 extends concentrically within the jacket 1 and provides slurry passage through which slurry is sent to the ground level. The space between the interior of the jacket 1 and the exterior of the return pipe 9 forms a passage P through which fluid, i.e., water is sent from a source above ground down to the ore cavity.

The bottommost section of the jacket 1 is a tool head or housing H having a slurry-throttling foot valve 6, screened slurry inlet 7, jacket opening 7a, bottom jet nozzles 8, slurry return pipe 9, underreaming jet nozzle 10, several watertight bulkheads 11 dividing the tool head H into a cutting nozzle chamber D an underreaming and bottom nozzle chamber U, and a slurry chamber S, nose cone 12, hydraulic power line 13 to the foot valve 6, hydraulic power line 14 to control valve 17 which admits water to a mining-nozzle chamber 15, jet mining or cutting nozzle 16, water bypass line 18, check valve 18a, level-controller chamber 19, level controller 20 (of the torque tube type or equivalent), inlet water line 21 to level controller, flushing water jets 22 to prevent plugging of vents 23, lift-air distributor 24, lift-air inlet 25, lift-air control valve 26 equipped with power-water inlet tube 27 and air inlet tube 28, perforated spacer plate 29, and auxiliary lift-air inlet valve 50. The several joints of slurry discharge pipe 9 are joined with threaded couplings 30 or they can be joined with joints of the Hydril-type 2. The upper sections of jacket 1 are equipped with spacer plate support rings 31 which support the perforated spacer plates 29 within jacket 1.

At the upper end of the tool string at ground level are located the standard blowout preventer 32, pressurized water inlet nozzle 34 (preferably rigid piping) and water hose 35 (preferably flexible hosing), pressurized air inlet nozzle 36 (preferably rigid piping), slurry discharge line 37 (preferably flexible hosing), rotary 38, double swivel 39, drawworks-driven travelling block 40, and slurry flow control system 41 all of which can be of conventional design, if desired. A flexible hose 37 connects the upper end of slurry return pipe 9 to the surface metering and control system 41. Surface metering and control system 41 comprises separator 42, liquid level controller 43, back pressure control or air vent valve 44, air flow meter 45, slurry-flow meter 46, slurry flow control valve 47, slurry density monitor 48, interconnecting lengths of slurry discharge piping 49 leading to a storage tank (not shown), vent air controller 51, and pressure controller 52. The liquid level controller 43 is electrically connected to air vent valve 44 to cause it to open more to vent more air as the slurry level in separator drops and to cause it to close more to vent less air as the slurry level rises. Air flow meter 45 feeds to vent air controller 51 signals indicative of the volume rate of air being vented. The vent air controller is electrically connected to slurry control valve 47 to cause it open more to remove more slurry from separator 42 as the volume rate of air vented drops below a predetermined set point and to cause it to close more to lessen the rate of slurry removal as the volume of air vented increases above the predetermined set point.

The foot valve 6 is biased by spring 61 to close the lower end of slurry return pipe 9 upon reduction of hydraulic pressure in line 13 and is powered to open said lower end by hydraulic pressure sent through line 13 by level controller 20. The valve 17 is of the full open-full closed type and is normally closed by spring bias unless hydraulic pressure is applied from level controller 20 via line 14. The level controller 20 is powered by hydraulic pressure through opening 21 which opens into the underreaming jet nozzle chamber. The level controller 20 includes a slurry level detection device or sensor 62 which actuates the controller in accordance with the level of slurry in the chamber 19. Said chamber 19 is formed by a watertight box B surrounding the inlet vents 23 and sealed to the inner wall of jacket 1 and to level controller 20.

One side of lift air control valve 26 is exposed to fluid pressure in passage P by means of tube 27. Valve 26 thus is powered towards open position by increase of fluid pressure in fluid passage P. The other side is exposed through tube 28 to air pressure in the ore cavity outside jacket 1 and is spring powered thereby towards closed position when the fluid pressure in passage P declines. Lift-air distributor 24 comprises an annular chamber 63 sealed to the periphery of slurry pipe 9. Perforations 64 pass through the pipe 9 within the chamber 63 to permit the passage of air into said pipe. A short air conduit 65 connects the inlet 25 with the chamber 63 so that air passes thereto from the ore cavity exterior of the jacket 1.

Auxiliary or alternate lift-air inlet valve 50 is biased to close by the pressure exerted by spring 66. Air under pressure is transmitted through tube 67 from the ore cavity exterior of jacket 1 for injection into the slurry rising in pipe 9. Tube 68 communicates with tube 67 and one side of valve 50 to transmit air under pressure thereto which assists spring 66 in urging the valve to closed position. Tube 69 communicates the other side of valve 50 with the pressurized fluid in chamber U. Thus, the fluid pressure in chamber U acts on said valve to urge it towards the open position.

In this embodiment of the invention the system is assembled and employed as follows in the mining of granular ores, such as phosphate rock, as a water slurry from subterranean formations: A conventional drilling rig is set up in the desired mining location and a bore hole 4 slightly larger than the diameter of the casing 3 is drilled almost through the caprock C to near the top of the ore body O. The casing 3 is then installed to the depth of the hole terminating in the caprock and cemented by cement 5 to the caprock C to prevent subsequent leakage of gas or water from the mining zone. Next the blowout preventer 32 is installed in the conventional way. A smaller diameter bore hole is then drilled through the ore body to accommodate the jacket 1. The diameter is preferably as large as possible, depending upon the size of the drill bit that could pass through the casing 3. This second bore would be drilled to a depth sufficiently far, e.g., 50 feet or more, below the bottom of the ore body 0 to permit the miner assembly or tool head H to be lowered sufficiently during the course of the mining operation for the jet mining nozzle 16 to reach the elevation of the bottom of the ore body so that the ore body can be completely mined.

As alternates to the foregoing procedure the larger casing bore hole may be drilled down to the entire depth required for mining the ore body, in which case the second smaller diameter bore hole to accommodate the jacket would not have to be separately drilled. Additionally, in place of cementing the casing 3 to the caprock C with cement 5, a mechanical seal, such as an inflatable packer, could be used. Use of the latter would facilitate the retrieval of the casing 3 for reuse after mining at a given well location has been completed.

Upon completion of drilling the jacket bore hole, equipping of the well is continued by installation of the completely preassembled bottom section or tool head H constructed and equipped as explained above and shown in FIGS. 2 through 5.

The tool head H is held in the slips of the rotary 38 after having been lowered into the casing to such an extent that only its jacket joint 2 and a short protruding length of slurry pipe 9 with its accompanying coupling 30 are visible above the rotary 38. The next section of well piping, or tool string L, is then installed. The next section comprises a length of jacket 1 which is internally fitted with a plate support ring 31 which is welded to the internal surface of the jacket, a perforated spacer plate 29 and a length of slurry pipe 9 with coupling 30. The inner diameter of the spacer plate 29 is only slightly larger than the outer diameter of the slurry pipe 9 so that the latter can easily slide therethrough and can be loosely supported by its coupling 30 allowing the bottom end of the slurry pipe 9 to protrude two to three feet beyond the bottom end of the jacket 1. This entire section subassembly composed of items 1, 31, 29, 9 and 30 is then lifted into position above the initially installed tool head H by the travelling block 40 and the protruding slurry pipe 9 of both sections are joined together by coupling 30. Then, the travelling block 40 lowers the jacket 1 and the two sections of the jackets 1 are joined together. Standard well-drilling joining procedures are employed.

The perforated spacer plate 29 not only lends temporary support to the lengths of slurry pipe 9 during installation as described hereinabove but also serves to "center" the pipes 9 to facilitate making up the pipe joints, and further permits the passage of water through the annular passage P formed by the inner wall of jacket 1 and the outer wall of pipe 9. In addition it also serves to stabilize the internal pipe 9, i.e., to prevent buckling, etc.

Additional sections of jacket 1 and slurry pipe 9 are installed as required until, as ascertained by calculation, a sufficient number of lengths of jacket 1 and pipe 9 have been installed that the underreaming nozzle 10 is at the same elevation as the top of the ore body (bottom of caprock). At this time the well string is equipped with its double swivel 39 and attachments made to it of water hose 35 and slurry discharge line 37. The water hose and slurry connections must be flexible hoses to allow for the vertical movement of the well piping as mining proceeds and the piping requires lowering further down into the formation. At this time the rigid piping connections can also be made to water nozzle 34 and compressed air nozzle 36.

Preliminary mining operations can then commenced by introducing water under pressure via hose 35. This water flows down the annulus formed between the slurry pipe 9 and the jacket 1, through the perforations of the spacer plates 29, through check valve **18*a* and water bypass line 18 and will issue forth into the underground formation via: vents 23 fed by flushing jets 22, bottom jets 8, and underreamer nozzle 10. Water will also issue from jet mining nozzle 16. Water for the latter enters the mining-nozzle chamber 15 via spring-to-close valve 17 which is opened by water pressure via line 14 from the level controller 20. At this stage of the operations the flow of water out of the jet mining nozzle 16 will be fairly short-lived because as the water level rises in the bore hole a level will be reached which will cause the level controller 20 to vent the hydraulic pressure from power water line 14 causing the spring-loaded valve 17 to close an stop the flow of water to the mining nozzle chamber 15.**

It is appropriate at this point to interject a detailed description of the operation of level controller 20 since it is vital to the performance and operation of the whole system and its action is referred to repeatedly. Level controller 20 operates in the following manner: At the normal operating slurry level, hydraulic pressure applied at inlet water line 21 will be transmitted to both valve 17 via line 14 and valve 6 via line 13 to maintain these two valves in the open position. However, level controller 20 has an internal system which sends opposite hydraulic pressure signals to the two valves as the slurry level changes. For example, if the slurry level rises above the normal operating set-point the hydraulic pressure to valve 6 gradually will increase and the valve will tend to open against spring action. At the same time, the hydraulic pressure to valve 17 will remain constant until a maximum predetermined operating high level is reached at which time the controller 20 will vent the hydraulic pressure from line 14 resulting in the rapid closing of valve 17. The reason for this type of action with respect to valve 17 is to obtain full nozzle pressure, when it is operating, for effective jet mining which would not be achieved if the valve action were of the modulating type. Conversely, as the slurry level drops the hydraulic pressure to valve 17 will be withheld until the level is slightly above normal, at which time it will be applied to open valve 17 completely. At the same time, as the slurry level drops, the hydraulic pressure will be gradually decreased to valve 6 and this valve will tend gradually to close due to spring action. It is to be noted that both valves close upon reduction in hydraulic operating pressure.

The principal flow out of the underreamer nozzle 10 continues and, as a result of the rotary motion of the jacket 1 made possible by the motor-driven rotary 38, the underreamer nozzle 10 continually opens a circular sump zone which will serve as a large-capacity surge chamber to reduce the sensitivity of level controller 20. Flow from the bottom jets 8 and the flushing water jets 22 is continuous also to prevent plugging or obstruction of movement of the well string by compacted slurry.

As the underreaming operation proceeds and the bore hole gradually fills with slurry, this slurry will enter level control chamber 19 via vents 23 and will also enter the slurry discharge pipe 9 via the slurry inlet 7, jacket opening 7*a*, and the lower end of pipe 9 since foot valve 6 is opened by hydraulic pressure via line 13 due to action of the level controller 20 as described above. As the level continues to rise, at the proper point it is necessary and desirable to begin pumping out the slurry. This is done in the normal operational manner of the embodiment, by introducing compressed air through nozzle 36. The air flows down the annular space between the jacket 1 and the casing 3 and thence into the underground ore cavity. As the air pressure builds up in the underground ore cavity, it forces the slurry up the slurry pipe 9 to a static height dependent upon the slurry density and the magnitude of the air pressure. The ore cavity pressure alone may or may not be sufficient to force the slurry to the surface, depending on the depth and slurry density.

In addition to forcing the slurry from the formation towards the surface, the compressed air in the ore cavity has other functions: (A) It will enter the slurry discharge pipe 9 via the lift-air inlet 25, lift-air control valve 26 and the perforated lift-air distributor 25 and mix with the slurry in pipe 9 thereby producing a mixture lower in density than the slurry itself and therefore capable of being forced to the surface with lower ore cavity air pressure than would otherwise be required. (B) It also enters the slurry discharge line 9 via the alternate lift-air control valve 50. (C) By pressurizing the ore cavity the air tends to support the roof of the cavity as mining proceeds and the pressure will tend to reduce in-leakage of water through the cavity walls. (D) Via conduit 28 the air pressure will assist the spring to cause the lift-air control valve 26 to close if the water pressure in the annular passage P between the jacket 1 and pipe 9 applied via opening 27 is reduced.

This latter action is desirable and noteworthy inasmuch as it allows the addition and removal of sections of the well piping without depressurizing the cavity. To do this, the water flow to the well through hose 35 and/or nozzle 34 is stopped. As a result, the water pressure in the jacket 1 drops, removing the hydraulic power from control valve 26 via power inlet 27 thus permitting air pressure via conduit 28, together with the return action of the spring, to close the valve and preventing a well blowout or blowback through the slurry discharge line 9 from this source, i.e., through air-lift inlet 25.

There are four other automatic devices which close upon reduction in water pressure and which have been specifically designed to act in concert with closure of control valve 25 in order to prevent a blowback. These are water control valve 17, check valve 18*a*, lift-air inlet valve 50, and foot valve 6. Valves 6 and 17 are each designed with a power spring which causes the respective valve plugs to rise and seal off the bottom end of the slurry discharge pipe 9 and seal off mining nozzle chamber 15 from annular passage P in case of loss of water pressure. The actions of valves 6 and 17 in response to changes in hydraulic pressure have been discussed in detail hereinabove in connection with the action of level controller 20. Check valve 18*a* seals off underreaming chamber U from passage P and lift-air inlet valve 50 closes in a similar manner as described hereinabove for air-lift inlet valve 26, upon loss of water pressure in passage P.

As underreaming proceeds and the well string is gradually lowered further down the well bore the jet miner nozzle 16 eventually reaches the elevation of the top of the ore deposit. When the slurry level is appropriate, i.e, not too high and not too low, the level controller 20 causes water to flow to mining nozzle compartment chamber 15 via valve 17 and thence out into the ore matrix via jet mining nozzle 16. In this regard it is important to note that the slurry level must be below the level of nozzle 16 so that the force of its jet is not diminished. The system is now in the normal operating mode and, as the rotary 38 continuously rotates the well string, and as the drawworks-driven travelling block 40 gradually lowers the miner assembly down the well bore, a circular cavity 60 to 120 ft. in dia. is produced in the ore body, with the slurry being continuously removed to the surface. In some instances, however, where the underground structure is too weak to support a large diameter cavity ceiling, the retreating-face technique of mining can be employed wherein the rotation of the miner is restricted to oscillation over a range of 180°.

In addition to control of the flow of water to the jet mining nozzle 16 and control of slurry foot valve 6 by level controller 20, the surface metering and control system described above can be included in this embodiment of the invention. Control system 41 is supplementary to the downhole level controller 20 and operates as follows: When the air/slurry mixture arrives at separator 42 via slurry discharge line 37, the air and slurry are separated into two phases. The air is vented via pressure control valve 44 and air flow meter 45, and the slurry is discharged via the discharge piping 49, flow meter 46, control valve 47 and density monitor 48. The entire control system can be interconnected with the necessary relays, integrators, etc., to make it completely automatic. However, sufficient local indicators and manual overrides are provided also to permit manual or hand operation of the system which is especially useful when starting up or shutting down operations.

The air volume required to air lift the slurry to the surface is determined by calculations and this air requirement is continually modified pursuant to the then current depth of mining, cavity pressure, flow resistance of the slurry in the discharge line 9, static lift of the slurry, and other miscellaneous head losses and the back pressure in separaor 42. This air requirement is used as the set point in a vent-air controller 51. When the volume of air vented via flow meter 45 is below the set point of the vent-air controller 51 this is an indication that the liquid level in the subterranean slurry sump adjacent the tool head H has increased to a high level and that the resultant increased static head in the slurry discharge line 9 has decreased the inflow of air via air lift valves 26 and 50. As a result of the decreased air flow, the vent-air controller 51 causes the slurry flow control valve 47 to open a proportionate amount to remove slurry from the separator 42 and lower its level. As the slurry level in separator 42 drops, the level controller 43 causes control valve 44 to vent more air and reduce the back pressure in the separator 42 which in turn increases the slurry flow from the mine. The increased slurry flow lowers the slurry level in the subterranean sump, thus allowing more air flow into the slurry line via air lift valves 26 or 50. As a result, when the air flow from separator 42 exceeds the set point on the vent-air controller 51 the process is reversed, i.e., the vent-air controller 51 causes slurry flow control valve 47 to close a proportionate amount and in turn the separator slurry level will rise and level controller 43 will cause pressure control valve 44 to close slightly. This increases back pressure in the separator 42 and decreases slurry flow from the mine.

Provisions are made for the pressure controller 52 to override the normal action of the vent-air controller 51 to insure maintenance of adequate back pressure to control the downhole inflow of air to provide sufficient force to pump the slurry to storage from the separator 42. The liquid level controller 43 is also capable of overriding normal control action in order to prevent an extreme low level occurring in the separator 42 and the resultant loss of air out the slurry discharge piping 49.

Determination of ore production rates can be made by an automatic totalizer based upon the density information supplied by monitor 48 and the slurry flow data supplied by slurry flow orifice meter 46. If the slurry density as determined by monitor 48 indicates too high a density, the density can be lowered by adding more water via the casing through nozzle 34 or by decreasing the rate of descent of the tool head H while maintaining the same input water rate. If the slurry density is too low, it can be increased by lessening the amount of water delivered to the ore cavity or by increasing the rate of descent of the tool head H.

The line feeding air to nozzle 36 can be equipped with a pressure controller and a pressure reducing valve to control the air pressure in the cavity at a predetermined value. The air inlet line to nozzle 36 can also be equipped with an air flow meter to assist in control of the mining operations.

When the tool head H is equipped with the alternate lift-air entry system 50 instead of the standard system involving lift-air distributor 24 the former can perform the functions of (A) providing lift air, (B) serving as a slurry level indicator. It can serve this latter function in conjunction with air flow meter 45, slurry flow meter 46 and density meter 48 since for a given slurry flow and slurry density the flow of air into the slurry line at lift-air entry valve 50, as indirectly measured by meter 45, will depend upon the height of the lift-air entry elevation above the slurry level. This lift-air entry valve 50 is also designed to close on low water pressure.

The alternate lift-air valve 50 can be used as a means of controlling well operation in place of level controller 20. In this case, it is desirable to modify the operation of surface control system 41 to provide (A) a fixed flow of slurry from separator 42, (B) a constant pressure on the separator, i.e., a constant back pressure on the well, and (C) a constant slurry density.

FIGS. 1 - 5 indicate a single size of pipe being used throughout the depth of the well for slurry piping 9. If the volumes of lift air required to be admitted to the slurry pipe 9 for satisfactory well operation result in excessive erosion on the slurry pipe 9 then increasingly larger diameter pipe can be employed in the upper reaches of the miner to maintain the air/slurry mixture velocities at less erosive levels.

When the ore body or a particular well or mine location has been exhausted the downhole well equipment, with the exception of the casing, can be salvaged immediately for use at a subsequent well location. In this case, the well assembly is equipped with additional standard equipment (not shown) to prevent a blowout when the tool head H is removed. The casing can be left in place until the compressed air in the ore cavity has been displaced by water and/or waste production slurries, etc., which will provide support for the caprock when the compressed air has been completely removed. As an economic measure, the underground compressed air is then used as the pressurizing air in a subsequent nearby producing well or mine.

Another embodiment of this invention is shown in FIGS. 6 through 10. This embodiment utilizes an underground pump for lifting the slurry out of the ore cavity to the ground surface. The pump can be driven by any sufficient means. In the embodiment shown in FIGS. 6 through 10 it is driven by a hydraulic turbine. The underground pump is useful in those situations where it is not desired or possible to use compressed air in the ore cavity and is useful in conjunction with compressed air systems such as that described in FIGS. 1 through 5 in mining very deep wells.

As exemplified in FIGS. 6 through 10, the jet miner system of this embodiment involves a vertical cylindrical jacket 101 which is fabricated in several lengths which are joined together with Hydril-type joints 102. The sections are assembled during the process of insertion into a predrilled well bore 104 through protective casing 103 which is sealed to the caprock or formation F with either cement 105, or an inflatable packer 105. Integral with the bottommost section of the jacket are its bottom nose cone 106 containing an underreamer nozzle 107 and a bore hole flushing jet nozzle 108, multi-stage hydraulic turbine 109 which is connected to multi-stage slurry pump 110 through stuffing box 111 and drive coupling 112, several openings 113 through the jacket for entrance of slurry from the cavity to the pump suction, slurry inlet and vent conduits 114 and **114*a* for pump compartment 115, two pump compartment flushing water nozzles 116, inlet water check valve 117 to watertight annular conduit 118 feeding water to turbine 109, watertight annular conduit 119 which conducts turbine discharge water to the mining or cutting jet nozzle chamber 120, jet mining nozzle 121, lift-air inlet 122, pressure-air conduit 123, lift-air control valve 124, hydraulic pressure inlet 125, lift-air distributor 126, slurry discharge pipe 127, and pipe coupling 128, perforated spacer plate 129, several watertight bulkheads 130 which divide pipe column 131 into the various compartments: pump compartment 115, turbine compartment 132, pump suction compartment 133, slurry control valve 134, electrically operated level controller 135, pressure water conduit 136 to level controller, pneumatic (or hydraulic, if desired) operator 137 including restraining spring 138 and linkage 138*a*, air vent 139, high-level sensor 140, low-level sensor 141, electrical cables 142 and 142*a* and conduit 143. The upper sections of jacket 101 are equipped with plate support rings 144. In the upper portions of the assemblage are located the casing water inlet nozzle 145, compressed air inlet nozzle 146, standard ground level blowout preventer 147, rotary 148, double swivel 149, water inlet flexible hose 150, slurry discharge flexible hose 151, drawworks-driven travelling block 152, air/slurry separator 153, level controller 154, vent-air control valve 155, vent-air flow meter 156, pressure controller 157, ore production totalizer 158, slurry flow meter 159, slurry flow control valve 160, slurry density monitor 161, slurry piping 162.** The several set-point controllers, ore production totalizer, and miscellaneous indicators, etc., can be housed in and displayed on a central operator's control panel.

A conventional drilling rig is set up in the desired mining location and a bore hole 104 slightly larger than the diameter of the casing 103 is drilled through the caprock F to the top of the enriched ore body O. The casing 103 is then installed to the depth of the hole and cemented with cement 105 to the caprock F to prevent subsequent leakage of gas or water from the mining zone. Next, the blowout preventer 147 is installed. A small diameter bore hole is then drilled to accommodate the jacket 101. The diameter would be as large as possible, depending upon the size of the drill bit that could pass through the casing 103. This second bore would be drilled to a depth of approximately 50 ft. or more below the bottom of the ore body 0. The additional depth is required to permit the miner assembly or tool head H to be lowered sufficiently during the course of the mining operation for the jet mining or cutting nozzle 121 to reach the elevation of the bottom of the ore body 0 so that the ore body can be completely mined.

As alternates to the foregoing procedures the larger casing bore hole 104 may be drilled the entire depth required for mining the ore body 0, in which case the second smaller diameter bore hole to accommodate the jacket 101 would not have to be separately drilled. Additionally, in place of cementing the casing to caprock F with cement 105, a mechanical seal 105, such as an inflatable packer, can be used. Use of the latter would facilitate the retrieval of the casing 103 for reuse after mining at a given well location has been completed.

Upon completion of drilling the jacket bore hole 104, equipping of the well is continued by installation of the completely preassembled tool head H as described above and shown in FIGS. 7 through 10.

This completely preassembled tool head H is held in the slips of the rotary 148 after having been lowered into the casing 103 to such an extent that only its jacket joint 102 and a short protruding length of slurry pipe 127 with its accompanying coupling 128 are visible above the rotary 148. The next section L of well piping is then installed. This next section consists of a length of jacket 101 which is internally fitted with a plate support ring 144 which is welded to the jacket 101, a perforated spacer plate 129 and a length of slurry pipe 127 with coupling 128. The inner diameter of the spacer plate 129 is only slightly larger than the outer diameter of the slurry pipe 127 so that the latter can easily slide through it but can be loosely supported thereon by its coupling 128. This allows the bottom end of the slurry pipe 127 to protrude two to three feet beyond the bottom end of the jacket joint 102. This entire section subassembly consisting of items 101, 144, 127, 128, and 129 is then lifted into position above the initially installed tool head H by the travelling block 152 and the protruding slurry pipes 127 of both the tool head H and the section L of the tool string are joined together. The travelling block 152 then lowers the jacket 101 of length L and it is joined to tool head H. Standard well-drilling joining procedures are employed.

The perforated spacer plate 129 not only lends temporary support to the lengths of slurry pipe 127 during installation but also serves to center the slurry pipe 127 to facilitate making up the pipe joints, and further, being perforated, permits the passage of water therethrough. In addition, it also serves to stabilize internal pipe 9, i.e., to prevent buckling, etc.

Additional sections or lengths L of jacket 101 and slurry pipe 127 are installed as required until, as ascertained by prior calculation, sufficient piping has been installed that the underreaming nozzle 107 is at the same elevation as the top of the ore body 0 (bottom of caprock F). At this time the tool string is equipped with its double swivel 149 and attachments are made to it of water and slurry hoses 150 and 151, respectively. The water and slurry connections must be flexible hoses to allow for the vertical movement of the tool string as mining proceeds and the tool string requires further lowering down into the formation. However, rigid piping connections can be made to water nozzle 145 and compressed air nozzle 146.

Preliminary mining operations are commenced by introducing water via hose 150. This water will flow down the annular passage P formed by the slurry pipe 127 and the jacket 101, through the perforations of the spacer plates 129, through check valve 117 and water bypass annular conduit 118, and thence through the body of drive turbine 109. Water will issue forth into the ore body 0 via borehole flushing nozzle 108 and underreamer nozzle 107. Water will also flow from the discharge of the turbine 109 and up annular conduit 119 from which it will discharge into slurry pump compartment 115 via flushing nozzles 116 and also into the jet mining nozzle compartment 120. From these latter two compartments the water will then issue forth into the ore body via conduits 114 and **114*a* and jet mining nozzle 121.**

As the slurry level rises in the borehole 104, it will eventually reach openings 113 and enter the slurry pump suction compartment 133 and rise inside the body of slurry pump 110. Since the slurry pump 110 is direct-connected to drive turbine 109 through drive coupling 112, and since the drive turbine 109 is rotating because water is flowing through the turbine, the slurry entering the pump suction of pump 110 is pushed up the slurry discharge line 127 towards the surface. However, until the level rises sufficiently high to actuate the slurry level control system the slurry discharge control valve 134 remains closed preventing passage of slurry up the slurry pipe 127.

The slurry level control system has as its principal elements the high-level sensor 140 and low-level sensor 141, both of which are connected to level controller 135 by electrical cables 142 and **142*a*, respectively. Level controller 135 is also supplied with power water via conduit 136 which in turn is connected to annular water conduit 118. Level controller 135 is also tied into hydraulic (or pneumatic) operator 137 via power water conduit 143. Operator 137 is provided with an air vent 139 and is attached to slurry discharge control valve 134 via power spring 138 and linkage 138*a*.**

In actual operation the slurry level control system works as follows: If the level should drop below sensor 141 an electrical signal is transmitted via cable **142*a* to controller 135 which stops the hydraulic power it receives via conduit 136 from being transmitted to the cylinder of slurry control valve operator 137 and thus allows spring 138 and linkage 138*a* to close slurry discharge control valve 134. Conversely, when the level again rises above the level of sensor 141, the reverse control action is not initiated until the level reaches sensor 140. When this happens, an electrical signal is sent to level controller 135 via cable 142 and as a result hydraulic pressure from conduit 136 is transmitted via conduit 143 to valve operator 137 where it overpowers the force of spring 138 and operates through linkage 138***a* to cause valve 134 to open. If desired, the ON-OFF action of control valve 134 in response to signals from sensors 140 and 141 may be made to more closely approximate modulating control by the inclusion of additional intermediate range level sensors between high-level sensor 140 and low-level sensor 141.

The fact that valve 134 closes upon loss of hydraulic pressure is important in that it permits installation and removal of sections L of the tool string without the need for depressurizing the ore cavity and prevents blowouts, especially when compressed air is used. To add or remove sections L, simply cut off the water supply to the well via connection 150 and the slurry valve 134 closes, as will lift-air control valve 124 which opens due to hydraulic pressure via inlet 125 and closes due to air pressure and spring action in the absence of hydraulic pressure. Additionally, check valve 117 prevents reverse flow of water and/or air to complete the system of blowout protection while adding or removing well string sections.

To return to the preliminary operations sequence, the principal flows of water out of the underreamer nozzle 107, flushing nozzle 108 and jet mining nozzle 121 continue and, as a result of the rotary motion of the jacket 101 made possible by the motor-driven rotary 148, the underreamer nozzle 107 continually opens a circular sump zone which serves as a large-capacity surge chamber to reduce the frequency of the cycling of the level controller 135. The jet mining nozzle 121 will be ineffective as a mining tool until the miner has been lowered to such an extent that the jet mining nozzle 121 is in the ore zone 0 below the bottom of the casing.

When the slurry level reaches sensor 140, control valve 134 opens and slurry is pumped to the surface via slurry discharge pipe 127. If it is assumed for the present that compressed air is not being used to pressurize the cavity then there is no need for surface control items 153, 154, 155, 156, 157, and 160, i.e., the slurry can be pumped from downhole directly to storage via hose 151 which is directly connected to piping 162 containing the flow meter 159 and the density monitor 161; the latter two items being tied into the ore production totalizer 158.

Slurry production-rate control will be exercised principally by surface control of the water flow input via hose 150. If the slurry density as measured by meter 161 is higher than desired it may be decreased by: (A) adding more water via the casing at nozzle 145, or (B) decreasing the rate of descent of the miner or tool head H while maintaining the same input water rate.

The use of compressed air in this embodiment in assisting the lifting of the slurry to the ground surface normally would only be needed in a very deep well to assist the pump 110. Additionally, since the tool head H equipped with turbine 109 and pump 110 is primarily intended for use in mining areas where the structure is so weak that the formation F will slough in as mining proceeds there is no need for compressed air to maintain the structural integrity of a cavity roof. For this reason, when the tool head H equipped with turbine 109 and pump 110 is used because of the weakness of the structure, the bottom-of-the-bed technique of mining is preferably employed as follows: Since the weak roof structure indicates lack of a stable caprock the casing 103 is installed so that its bottom end is within a few feet of the bottom of the ore body 0 in order to protect the jacketed miner from damage as the ore body sloughs in. The jacketed miner H is then installed so that the jet mining nozzle 121 is located just below the end of the casing 103, e.g., within a foot or so of the bottom of the ore bed 0. The tool head H is then rotated keeping the jet mining nozzle 121 at this single elevation. The entire ore body 0 is mined as the upper portions continually slough off and fall into the zone of operation of the mining nozzle 121.

When compressed air is used in conjunction with the pump 110 in a deep-well operation, or when mining in a weak structure, and assuming an extended, almost full-length well casing 103 described in the previous paragraph is employed, the air when added via conduit 146 flows down the annular space between the casing 103 and the jacket 101. A downhole seal is installed in this annular space, below the air inlet to valve 124, in order to provide sufficient pressure for lift-air injection and to limit the amount of air entering the formation. During normal operation a portion of this air enters the slurry discharge pipe 127 via valve 124 and mixes with the slurry to form a mixture of lower density than the slurry alone thereby reducing the static head against which the turbine 109 and pump 110 have to work. Additional functions of the air are: (A) to impose air pressure via conduits 139 and 123 to assist in closing valves 134 and 124, respectively, upon reduction in water pressure operating via openings 143 and 125, respectively, (B) to flow out into the formation at the bottom end of the casing 103 and fill in the void spaces of the ore cavity 0 or sloughed-in structure and minimize in-leakage of formation water into the immediate mining zone.

When air is used the action of the downhole level control system would remain the same as described hereinabove but the surface control system would be more complex and would operate as follows: The air/-slurry mixture reaching ground level enters separator 153 and the air is vented to the atmosphere via back pressure control valve 155 and vent-air meter 156. Modulating operation of valve 155 is under the control of pressure controller 157 which is set to maintain a constant pressure sufficient to: (A) pump the slurry from the separator 153 to storage and (B) control by back pressure the input of lift air via control valve 124 at optimum operating levels. Air meter 156 serves no automatic control function but does serve as a guide to the performance of the system. The sole function of level controller 154 is to control the modulating operation of slurry flow control valve 160 in order to maintain a more-or-less constant level in separator 153. Slurry flow meter 159 and density monitor 161 provide inputs to ore production totalizer 158.

The line feeding air to nozzle 146 can be equipped with a pressure controller and a pressure reducing valve to control the air pressure applied to the cavity at desired levels. This air line can also be equipped with an air flow meter to assist in control of the mining operation.

Figure 11:
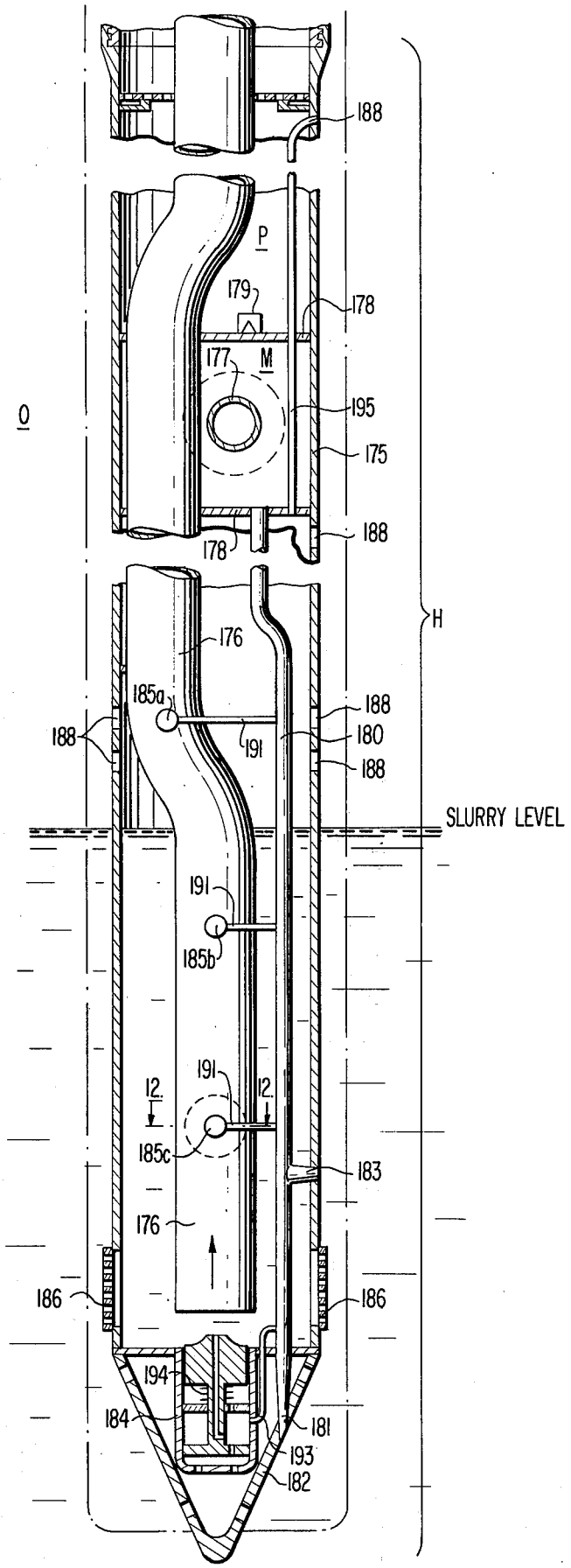
FIG. 11 is a view in elevation, partly broken away and partly in section, showing the tool head of still another embodiment of the invention.
Figure 12:
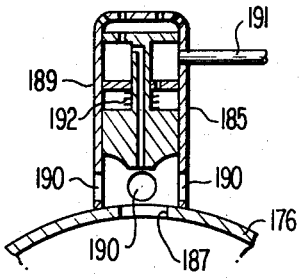
FIG. 12 is a sectional view taken on line 12—12 of FIG. 11.

With the use of surface instrumentation as shown in FIG. 1 on the slurry line 37 and air vent, the mining operation can be performed with a jet miner reduced to a simple stream-lined unit. Such a jet miner is shown in FIGS. 11 and 12. The miner H is comprised of a pipe jacket 175 serving as the injection water conductor and contains an inner pipe 176 for the return flow of slurry to the surface. Also contained in the jacket 175 is a mining jet nozzle 177 enclosed by watertight bulkheads 178 above and below the nozzle 177 forming a mining jet chamber M. A check valve 179 is positioned in the top bulkhead to stop return flow of water. A bypass pipe 180 for water flow from chamber M to the lower section of jacket 175 is also provided. This water flow supplies water to a bottom jet 181 in the hard nose 182 provided at the bottom of the jacket 175, and to an underreaming jet 183. It also provides the water pressure to open a slurry foot valve 184 and lifting air inlet valves 185. Blowout prevention valves operating on low water pressure would be the only downhole controls; these comprise the foot valve 184 similar to that disclosed in FIG. 3 on the slurry return pipe 176, three lifting-air inlets 185, and the check valve 179 in the water passage P. Pressurizing of the cavity 0 will support the roof and reduce inflow of ground water. Pressurizing air is supplied down the casing as explained in regard to FIGS. 1-3. The casing has a pressure seal to the jacket 175 to allow vertical and rotational movements or the miner. Near the bottom of the jacket 175 is a screened section 186 to allow the entrance of slurry into the bottom of the slurry pipe 176. Just under the lower bulkhead 178, the slurry pipe 176 has an orifice 187 or a series of orifices 187 for inlet of lifting air supplied through vents 188 in the jacket 175 from the pressurizing air in the cavity 0.

The three lifting-air inlet valves 185 are essentially of the same construction as shown in more detail in FIG. 12. Each valve 185 comprises a housing 189 fixed to slurry pipe 176 over an orifice 187. The housing 189 is formed with holes 190 which permit pressurized air to enter the slurry pipe 176 through orifices 187. Air pipe 195 connects uppermost vent 188 with the interior of jacket 101 for supplying pressurized air from the cavity to orifices 187, especially in those cases where the lower vents 188 become clogged. Tube 191 connects the interior of the housing above the valve with pressurized water from bypass pipe 180. Water pressure transmitted through tube 191 forces the valve 185 to the open position, i.e., to open the holes 190 to permit pressurized air (if any) to enter from the interior of jacket 175 into the slurry pipe 176. Spring 192 urges the valve 185 to the closed position, i.e., to close holes 190, and closes the valve when water pressure in bypass 180 drops below a certain point.

The foot valve 184 is of the same type as that shown in FIG. 3. Water tube 193 connects valve 184 to bypass pipe 180 and transmits water pressure (if any) therefrom to the valve 184. Water pressure transmitted through tube 193 forces valve 184 to the open position and spring 194 urges the valve 184 to the closed position where the lower end of slurry pipe 176 is closed off when water pressure in bypass pipe 180 drops below a certain point.

The liquid level of the slurry pool in the sump created by the underreamer nozzle jet 183 is controlled by the size and location of the air inlet orifices 187 relative to the fluid flow and the back pressure regulated on the slurry line by ground level equipment as shown in FIG. 1. The flow of air through a given orifice 187 in the slurry pipe 176 is proportional to the elevation of the orifice above the slurry level and is proportional in volume to the volume of slurry passing through pipe 176 and is modified by back pressure and other miscellaneous imposed resistances, and, of course, varies with the specific gravity of the slurry.

The instrumentation on the surface (see FIG. 1) can be used to control the operation of the miner after the system has been calibrated for water and some adjustment has been made to the response timing to dampen the hunting of the controllers. On the slurry line 37 the separator 42 has a level controller 43 operating the air vent valve 44 which holds a back pressure in the separator 42 sufficient to control the well and to flow the slurry away from the separator. The air volume required for airlift of the slurry is established by a calculation adjusted by calibration, and experience is used as a floating set point on the vent air flow controller 51. The set point is modified by the depth of mining, cavity pressure, flow resistance of the slurry, static lift of the slurry, other miscellaneous head losses and the applied back pressure in the separator 42 for a control variable.

When the vented air volume is below the adjusted set point of the air flow controller 51, the liquid level in the slurry sump is too high and the slurry control valve 47 opens proportionally to the intensity of the flow controller 51 signal. This increases the slurry flow and lowers the liquid level in the separator 42, thus the liquid level controller 43 vents more air and reduces the back pressure which increases the slurry flow from the mine. The increased slurry flow from the mine lowers the liquid level in the sump, thus delivering more air flow to the slurry pipe 176 through lift air valves 185. When the air flow exceeds the adjusted set point the process is reversed. To help dampen overshooting and cycling, the back pressure controller can be provided with a delayed reverse action timed and calibrated to dampen cycling and restore the set back pressure. The mining rate in tons or cubic yards per hour can be read from combination of the slurry flow and the specific gravity. This system can be equipped with an overriding hand system to permit manual takeover for starting up, final cleanup and other special situations or emergencies. Water added directly to the casing can be used to dilute the slurry without changing the amount of mining jet water being used. The functions of starting, cleanup, barren-zone movement, etc., can be programmed to proceed at the most efficient mining rate.

The use of a higher cavity pressure, but something less than the overburden load, can force a flow to the surface of slurry of about 1.3 specific gravity or a 37% solids by weight. This procedure can save the need to use lifting air but might have some increase in air loss to the formation. The slurry level in the cavity can be indicated on the surface by measuring a small flow of air (5 to 10 cfm) out of the surface separator 42, which air enters the slurry pipe 176 downhole at the top air inlet valve 185 sized for a 1-foot head of 1.3 specific gravity slurry. If the air flow rate increases, the slurry level is more than 1 foot below the air inlet valve and a decreasing air flow rate means a higher slurry level. The downhole slurry level is also controlled by adjustment of the slurry flow control valve 47. Corrections can be made to accommodate any changes in specific gravity of slurry. The small changes in air volume for level indication will have an insignificant effect on the control system as the airlift and the friction loss changes are both small and are made even smaller by acting in opposite directions.

Cavity-pressure pumping permits the use of a uniform diameter slurry pipe 176; however, a 6 inch dia. pipe above the 5 inch dia. in the bottom section provides less friction and accommodates the level indication air flow within the desired 8 ft./sec. velocity. By use of the screen to control the particle size in the slurry line to ½ inch or less, a velocity down to 6 ft./sec. should be sufficient to prevent plugging. The horizontal ground level slurry lines after the separator 42 have a critical velocity of 8.18 ft./sec. in 5 inch dia. pipe or 500 gpm. For the lower velocities, a bed of solids is likely to settle out in the lower part of the pipe. The mixture of air, solids and water has a velocity about 15% higher, but the critical velocity of such a mixture may be uncertain in the line going to the separator 42.

The separator 42 back pressure is proportional to the density of the slurry, and the liquid level controller 43 vents to a constant level. The pressure across the mining nozzle is determined by experience and is the controlling factor of the mining radius of the cavity. When a lower slurry concentration is desired, water can be fed directly into the casing through nozzle 34.

The second air inlet valve 185A can be sized for the desired airlift air volume and follow the constant air volume control operating at a lower underground slurry level than for smaller air volume. The third air inlet valve 185B is available if high slurry density mining is needed or in case of low cavity pressure or as protection against plugging the slurry pipe 176 by elevating the miner to blowout the line.

The slurry sump in the mining cavity should be of a diameter small enough to respond to changes in slurry flow, but large enough to dampen hunting of the controls. This diameter is a function of the nozzle, the pressure drop across the nozzle and of the resistance of the matrix to be slurried. Too much water at this point could be detrimental to the slurry concentration. The mining pattern of circular cavities with a well spacing a few feet greater than the mining diameter can be expected to have a low matrix recovery. Also, with a 5° to 8° slope of the bottom there would be a greater loss at the longer diameters. This pattern is well suited to rotation of the miner, high cavity pressure, mining down to or from the bottom, and back filling with water or tailings slurry. In case of a roof failure in the mined-out areas there probably would be irregular surface subsidence.

A retreating-face-type mining pattern can be performed from the bottom of the bed with a half rotation oscillation and a low set casing. This pattern could provide a higher recovery percentage and probably a better surface condition. This jet miner is a good unit to test the feasibility of slurry mining in the 250 ft. depth with caprock for a tight roof for pressurization and a friable matrix suitable for hydraulic mining. The downhole part of the unit is very simple, yet with the surface controls it can perform over a wide range of conditions. Hand control or overriding controls provide easy operation from the instrument indications.

In summary, the mining procedure generally comprises setting up the rig for drilling, drilling the wellbore 4(104), and setting the casing 3(103); then installing the jet miner H and making the surface connections to water supply, slurry storage, power supply, air compressors, when required, and instruments with controls. The single-hole jet miner is then operated to cut out a cylindrical chamber, e.g., a thirty-foot radius cylinder, in the phosphate matrix and deliver the ore to the ground surface as a slurry. After completing cleanup of the mining chamber, the air pocket is filled by pumping water or tailings, etc. down the well to minimize surface subsidence.

The jet miner H includes at least one mining water jet nozzle 16 (121) directed into the ore body and supplied with water to form the slurry. This downhole equipment is free to rotate 360° if one mining jet is used or at least 180° if two are used and is also capable of vertical movement in order to be able to mine the entire depth of the ore body; the rotation and vertical movement being supplied by surface machinery which includes the derrick, drawworks and engine, pressure seal rotary, and special swivel. The surface connections for the slurry line, water line, power cables, and instrument control tubing are preferably made with flexible hose which will accommodate the vertical and oscillatory movements of the downhole equipment.

An additional variation of jet miner employment is the bottom-of-the-bed technique wherein the ore bed is mined while the jets are oscillated at a fixed elevation at the bottom of the bed wherein the oscillation begins at the bottom and the jets are gradually raised.

When bottom-of-the-bed mining is used, it is helpful to have the cutting jet nozzle 16 or 121 also oscillate vertically to wash down the overhead portions of the ore bed if it does not fall freely. A water motor with gears, cams and cranks can provide a preprogrammed movement of the nozzle without controls to the ground level. Two cutting jet nozzles 16 (121) set 180° apart can be used and the tool head can be oscillated over a range of 180° to provide a full 360° cutting field.

The hydraulic turbine 109 can be replaced, if desired, with an eductor, e.g., a venturi pump. Also, if desired, it can be replaced by a pneumatic motor or turbine or with an electric motor for driving pump 110. However, the need to run air lines or electric lines to the pneumatic turbine or electric motor complicates the tool string and renders its assembly or disassembly more difficult and time consuming. When an electric motor is used, there is a watertight bulkhead between the motor and pump to allow the motor to operate in air (pressurized). The motor cooling is by air circulated on water coils; the water from the coils can then be used for bottom jets, sealing and lubrication.

Also, the mining head H can incorporate a radius-measuring meter for measuring the distance to the ore cavity walls at a particular instant. Such a meter can be of the reflected wave type and would assist in better controlling the mining operation.

Level controllers 20 and 137 can be of a construction similar to any of a number of known level controllers available on the market, e.g., the one made and sold by Fisher Governor Company, Marshalltown, Iowa under the tradename "Leveltrol". Lift air control valves 26 and 124 are of the butterfly type and are conveniently assembled from valve components acquired, for example, from Fisher Governor. Liquid level controllers 43 and 154 can be any one of a known number of level controllers available on the market, e.g., the leveltrol controller identified above. Back pressure control valves 44 and 155 can be of any suitable type, e.g., a Fisher Governor valve with a globe body. Air flow meters 45 and 156 are readily available components, such as the differential pressure cells manufactured by the Foxboro company, 3321 Transcontinental Drive, Metairie, Louisiana. Slurry-flow orifice meters 46 and 159 are regular orifice meters, such as, those made by Foxboro. Venturis and magnetic flow meters can also be used. Slurry-flow control valves 47 and 160 can be ball valves obtained from Fisher Governor. Single-seated plug valves can also be used. Slurry density monitors 48 and 161 are readily available and can be obtained, for example, from Dynatrol Automation Products Corporation, 3033 Maxroy Street, Houston, Texas. Vent air controller 51 and ore production totalizer 158 can be obtained from Foxboro under the category of "small computers". These are devices that accept differential pressure signals from other transmitters and send out corresponding electrical signals. Pressure controllers 52 and 157 are also available, e.g., from Foxboro. An example is the pressure transmitter known as Foxboro Model 45-P. Sensors 40 and 41 are manufactured by Fisher Governor among others and are pressure-activated liquid level sensors. Hydraulic operator 137 can be any air cylinder that transmits motion from pressure, like a piston. These are available from Fisher Governor, for example. Drive turbine 109 casn be a hydraulic turbine manufactured by either Byron Jackson Pumps, P. O. Box 2017 Terminal Annex, Los Angeles, California or the Worthington Corporation, P. O. Box 211, Livingston, New Jersey or any other suitable turbine. Slurry pump 110 can be an impeller turbine-type pump manufactured by either Byron Jackson or Worthington or any other suitable pump.

What is claimed is:

1. Apparatus for mining a subterranean deposit of granular ore by forming a slurry thereof with a fluid comprising:

a. a rotatable tool string having a first fluid passage through which fluid flows downwardly and a first slurry passage through which a slurry of said fluid and granular ore flows upwardly, b. supported therefrom underground a substantially rigid housing containing an outwardly directed cutting jet nozzle for impinging said fluid against said ore to form said slurry and having 1. a second fluid passage therein connecting said first fluid passage with said jet nozzle.
2. a slurry inlet through said housing,
3. a second slurry passage connecting said inlet with said first slurry passage,
4. a valve for controlling the amount of slurry passing through said second slurry passage and into said first slurry passage, said valve being biased to close,
5. means to open said valve in response to hydraulic pressure in a fluid passage, and
6. means for introducing air under pressure into the slurry rising in said slurry passages to assist the rise of said slurry to ground level.

2. Apparatus as claimed in claim 1 wherein said means for introducing air under pressure includes valve means biased to close to preclude air from entering into said slurry and powered by hydraulic pressure in one of said fluid passages to open to admit air into said slurry.

3. Apparatus as claimed in claim 1 wherein there is provided at ground level:

a. a seperator for separating the air from said air-slurry mixture, b. means for venting said separated air from said separator, c. means for measuring the rate of air vented, d. means for removing separated slurry from said separator, e. first valve means for increasing the amount of air vented from said separator when the slurry level in said separator is at or below a predetermined minimum and decreasing the amount of air vented when said slurry level is above said predetermined minimum, f. second valve means for increasing the amount of slurry removed from said separator when the rate of air vented falls below a predetermined minimum and decreasing the amount of slurry removed when the rate of air vented rises above said predetermined minimum, whereby the back pressure in said separator is lowered when the amount of slurry removed and the amount of air vented are increased to thereby increase the flow of air-slurry mixture to said separator causing a lowering of the slurry level underground and increasing the amount of air mixed with said slurry underground and said back pressure is raised when the amount of air and slurry removed is decreased to thereby decrease the flow of air-slurry mixture to said separator causing a rise of the slurry level underground and decreasing the amount of air mixed with said slurry underground.

4. Apparatus for mining a subterranean deposit of granular ore by forming a slurry thereof with a fluid comprising:

a. a rotatable tool string having a first fluid passage through which fluid flows downwardly and a first slurry passage through which a slurry of said fluid and granular ore flows upwardly, b. supported therefrom underground a substantially rigid housing containing an outwardly directed cutting jet nozzle for impinging said fluid against said ore to form said slurry and having 1. a second fluid passage therein connecting said first fluid passage with said jet nozzle,
2. A slurry inlet through said housing,
3. a second slurry passage connecting said inlet with said first slurry passage,
4. a first valve for controlling the amount of slurry passing through said second slurry passage,
5. a level controller in said housing for detecting the level of said slurry adjacent said housing and for actuating said first valve gradually towards the open position when said slurry level rises above the normal operating set-point and for actuating said first valve gradually towards the closed position when said slurry level drops below the normal operating set-point,
6. a second valve disposed in said second fluid passage for controlling the flow of fluid to said jet nozzle wherein said level controller actuates said second valve to close when said slurry reaches a predetermined maximum level adjacent said housing and actuates said second valve to open when said slurry reaches a predetermined minimum level adjacent said housing,
7. a bottom jet nozzle which discharges fluid into said slurry outside of said housing to discourage restrictions on the movement of said housing, and a third fluid passage connecting said bottom jet nozzle with said first fluid passage to supply fluid to said bottom jet nozzle, and
8. a check valve in said third fluid passage which permits passage of fluid from said second fluid passage to said bottom jet and prevents passage of fluid from said bottom jet to said second fluid passage.

5. Apparatus as claimed in claim 4 wherein said housing is provided with air means for introducing air under pressure into slurry in said second slurry passage at a point above the operating level of slurry outside said housing to form an air-slurry mixture and assist said slurry in rising in said second slurry passage and an air valve in said air means for decreasing the flow of air therethrough when the fluid pressure in said first fluid passage decreases and for increasing the flow of air therethrough when said fluid pressure increases said air valve being adapted to close when said fluid pressure reaches a predetermined minimum.

6. Apparatus as claimed in claim 4 wherein said first valve is at the inlet to said second slurry passage.

7. Apparatus as claimed in claim 4 wherein an underreaming jet nozzle is located below said cutting jet nozzle, said underreaming jet nozzle being connected to said third fluid passage.

8. Apparatus as claimed in claim 4 wherein there is provided a second air means for introducing air under pressure into slurry rising in the second slurry passage, said second air means being located below said cutting jet and above the level of slurry outside said housing, said second air means forming an air-slurry mixture and assisting said slurry in rising in said passage, a third valve in said second air passage biased towards the closed position, fluid pressure in said third fluid passage urging said third valve toward the open position, said third valve being adapted to close when the fluid pressure in said third fluid passage reaches a predetermined minimum.

9. Apparatus as claimed in claim 8 wherein there is provided at ground level:

a. means for measuring the amount of air in said air-slurry mixture reaching ground level.

b. means for measuring the amount of slurry in said air-slurry mixture reaching ground level, and c. means for measuring the density of said slurry reaching ground level whereby the level of slurry underground outside said housing is indicated.

10. Apparatus for mining a subterranean deposit of granular ore by forming a slurry thereof with a fluid comprising:

a. a rotatable tool string having a first fluid passage through which fluid flows downwardly and a first slurry passage through which a slurry of said fluid and granular ore flows upwardly, said tool string comprising (1) one or more sections each having an inner pipe through which said slurry flows upwardly and an outer pipe substantially concentric with said inner pipe forming an annular passage outside the inner pipe and inside the outer pipe through which fluid flows downwardly, said inner pipe being connected to said second slurry passage and said annular passage being connected to said second fluid passage, and (2) a coupling connecting said inner pipe of one section to said inner pipe of an adjacent section, and a perforated spacer positioned in the upper end of said outer pipe, said spacer having a hole of a sufficient size through which said inner pipe loosely slides but through which said coupling is unable to slide, said spacer being supported against downward movement in said outer pipe, whereby the the lower end of said inner pipe projects below the lower end of said outer pipe when said outer pipe is suspended vertically to facilitate the joining of sections, b. supported therefrom underground a substantially rigid housing containing an outwardly directed cutting jet nozzle for impinging said fluid against said ore to form said slurry and having 1. a second fluid passage therein connecting said first fluid passage with said jet nozzle,
2. a slurry inlet through said housing,
3. a second slurry passage connecting said inlet with said first slurry passage,
4. a valve for controlling the amount of slurry passing through said second slurry passage, and
5. a level controller in said housing for detecting the level of said slurry adjacent said housing and for actuating said valve gradually towards the open position when said slurry level rises above the normal operating set-point and for actuating said valve gradually towards the closed position when said slurry level drops below the normal operating set-point.

11. Apparatus for mining a subterranean deposit of granular ore by forming a slurry thereof with a fluid comprising:

a. a rotatable tool string having a first fluid passage through which fluid flows downwardly and a first slurry passage through which a slurry of said fluid and granular ore flows upwardly, b. supported therefrom underground a substantially rigid housing containing an outwardly directed cutting jet nozzle for impinging said fluid against said ore to form said slurry and having 2. a second fluid passage therein connecting said first fluid passage with said jet nozzle,
2. a slurry inlet through said housing,
3. a second slurry passage connecting said inlet with said first slurry passage,
4. a valve for controlling the amount of slurry passing through said second slurry passage,
5. a level controller in said housing for detecting the level of said slurry adjacent said housing and for actuating said valve gradually towards the open position when said slurry level rises above the normal operating set-point and for actuating said valve gradually towards the closed position when said slurry level drops below the normal operating set-point,
6. a hydraulic turbine disposed in said second fluid passage and driven by fluid passing through said passage, and a pump driven by said turbine disposed in said second slurry passage to pump slurry upwardly therethrough, and
7. a bottom jet nozzle for discharging fluid into said slurry outside said housing to discourage restrictions on movement of said housing, said bottom jet nozzle being connected to said second fluid passage after said fluid has passed through said turbine.

12. Apparatus as claimed in claim 11 wherein said valve for controlling the amount of slurry passing through said second slurry passage is located above said pump.

13. Apparatus as claimed in claim 11 wherein said housing is provided with means for introducing air under pressure into slurry rising in the second slurry passage to form an air-slurry mixture and assist slurry in rising in said second slurry passage and an air valve in said air passage for decreasing the flow of air therethrough when the fluid pressure in said second fluid passage decreases and for increasing said flow of air therethrough when the fluid passage in said second fluid passage increases, said air valve being adapted to close when said fluid pressure reaches a predetermined minimum.

14. Apparatus as claimed in claim 11 wherein said slurry inlet and pump are positioned above said turbine.

* * * * *